United States Patent [19]

Okamura et al.

[11] Patent Number: 4,985,088

[45] Date of Patent: Jan. 15, 1991

[54] FE-BASED SOFT MAGNETIC ALLOY PRODUCT

[75] Inventors: Masami Okamura; Takao Sawa, both of Kanagawa, Japan

[73] Assignee: Kabushiki Kaisha Toshiba, Kawasaki, Japan

[21] Appl. No.: 353,031

[22] Filed: May 17, 1989

[30] Foreign Application Priority Data

May 17, 1988 [JP] Japan ..... 63-118332

[51] Int. Cl.[5] ..... H01F 1/04

[52] U.S. Cl. ..... 148/305; 148/302; 148/304; 420/89

[58] Field of Search ..... 148/304, 305, 306, 307, 148/302; 420/83, 89

[56] References Cited

U.S. PATENT DOCUMENTS 4,581,080 4/1986 Meguro et al. ..... 148/307

FOREIGN PATENT DOCUMENTS 0271657 6/1988 European Pat. Off. ..... 148/305
2539002 4/1976 Fed. Rep. of Germany ..... 148/307
56-133447 10/1981 Japan ..... 148/307
61-87848 5/1986 Japan ..... 148/304
63-239906 10/1988 Japan ..... 148/305

*Primary Examiner*—John P. Sheehan

*Attorney, Agent, or Firm*—Foley & Lardner, Schwartz, Jeffery, Schwaab, Mack, Blumenthal & Evans

[57] ABSTRACT

Fe-based soft magnetic alloy having excellent soft magnetic characteristics with high saturated magnetic flux density, characterized in that it has fine crystal grains and is expressed by the general formula:

$$(Fe_{1-a-b}\,Cu_aM_b)_{100-c}\,Y_c$$

where "M" is at least one or more selected from rare earth elements, "Y" is at least one or more selected from Si, B, P, and C, and "a", "b" and "c" are as follows:

$$0.005 \leqq a \leqq 0.05$$

$$0.005 \leqq b \leqq 0.1$$

$$15 \leqq c \leqq 28 \text{ (at \%)}.$$

Also described is a method of treating the alloy to segregate fine crystal grains which comprises heat treating the alloy for a period of from one minute to ten hours at a temperature of from 50° C. below the crystallization temperature to 120° C. above the crystallization temperature.

11 Claims, No Drawings

FE-BASED SOFT MAGNETIC ALLOY PRODUCT

BACKGROUND OF THE INVENTION

This invention relates to Fe-based, soft magnetic alloys.

Conventionally, iron cores of crystalline materials such as permalloy or ferrite have been employed in high frequency devices such as switching regulators. However, the resistivity of permalloy is low, so it is subject to large core loss at high frequency. Also, although the core loss of ferrite at high frequencies is small, the magnetic flux density is also small, at best 5,000 G. Consequently, in use at high operating magnetic flux densities, ferrite becomes close to saturation and as a result the core loss is increased.

Recently, it has become desirable to reduce the size of transformers that are used at high frequency, such as the power transformers employed in switching regulators, smoothing choke coils, and common mode choke coils. However, when the size is reduced, the operating magnetic flux density must be increased, so the increase in core loss of the ferrite becomes a serious practical problem.

For this reason, amorphous magnetic alloys, i.e., alloys without a crystal structure, have recently attracted attention and have to some extent been used because they have excellent soft magnetic properties such as high permeability and low coercive force. Such amorphous magnetic alloys are typically base alloys of Fe, Co, Ni, etc., and contain metalloids as elements promoting the amorphous state, (P, C, B, Si, Al, and Ge, etc.).

However, not all of these amorphous magnetic alloys have low core loss in the high frequency region. Iron-based amorphous alloys are cheap and have extremely small core loss, about one quarter that of silicon steel, in the frequency region of 50 to 60 Hz. However, they are extremely unsuitable for use in the high frequency region for such applications as in switching regulators, because they have an extremely large core loss in the high frequency region of 10 to 50 kHz. In order to overcome this disadvantage, attempts have been made to lower the magnetostriction, lower the core loss, and increase the permeability by replacing some of the Fe with non-magnetic metals such as Nb, Mo, or Cr. However, the deterioration of magnetic properties due to hardening, shrinkage, etc., of resin, for example, on resin molding, is large compared to Co-based alloys, so satisfactory performance of such of such materials is not obtained when used in the high frequency region.

Co-based, amorphous alloys also have been used in magnetic components for electronic devices such as saturable reactors, since they have low core loss and high squareness ratio in the high frequency region. However, the cost of Co-based alloys is comparatively high making such materials uneconomical.

As explained above, although Fe-based amorphous alloys constitute cheap soft magnetic materials and have comparatively large magnetostriction, they suffer from various problems when used in the high frequency region and are inferior to Co-based amorphous alloys in respect of both core loss and permeability. On the other hand, although Co-based amorphous alloys have excellent magnetic properties, they are not industrially practical due to the high cost of such materials.

SUMMARY OF THE INVENTION

Consequently, having regard to the above problems, the object of the present invention is to provide an Fe-based, soft magnetic alloy having high saturation magnetic flux density in the high frequency region, with excellent soft magnetic characteristics. The invention is characterized by having fine crystal grains and a particular composition.

According to the invention there is provided, a Fe-based, soft magnetic alloy having fine crystal grains dispersed in an amorphous phase, as described in the following formula:

$$(Fe_{1-a-b}\,Cu_a\,M_b)_{100-c}\,Y_c$$

where "M" is at least one rare earth element, "Y" is at least one element selected from Si, B, P, and C, and wherein "a" and "b"are as follows:

$$0.005 \leqq a \leqq 0.05$$

$$0.005 \leqq b \leqq 0.1$$

and "c" expressed in atomic % is as follows:

$$15 \leqq c \leqq 28.$$

In a preferred embodiment of the invention the fine crystal grains of the Fe-based alloy have an area ratio of at least 30%. The term "area ratio" of the fine grains, as used herein means the ratio of the surface of the fine grains to the total surface in a plane of the alloy as measured, for example, by photomicrography or by microscopic examination of ground and polished specimens. Advantageously, at least 80% of the fine grains are in the range of 50 Åto 300 Å.

Thus, a desirable characteristic of the invention is that fine crystal grains are present in an alloy having the aforesaid composition. It is especially desirable that the fine crystal grains are present in the alloy to the extent of at least 30% in terms of area ratio. It is further preferable that crystal grains of 50 Åto 300 Ärepresent at least 80% of the aforesaid fine crystal grains.

In another aspect of the invention, the alloy is treated to segregate fine crystal grains by a method which comprises heat treating the alloy for a period of from one minute to ten hours at a temperature of from 50° C. below the crystallization temperature to 120° C. above the crystallization temperature.

DETAILED DESCRIPTION OF THE PREFERRED EMBODIMENTS

An alloy in accordance with the invention contains Fe, Cu, at least one rare earth element and at least one of Si, B, P, and C, in accordance with the formula $(Fe_{1-a-b}\,Cu_aM_b)_{100-c}\,Y_c$ where "M" is at least one rare earth element, "Y" is at least one element selected from Si, B, P, and C, and wherein "a" and "b" are as follows:

$$0.005 \leqq a \leqq 0.05,\ 0.005 \leqq b \leqq 0.1 \text{ and}$$

"c"0 expressed in atomic % is within the range of $$15 \leqq c \leqq 28.$$

It is important that the alloy of the invention contain the aforementioned components in the amounts and proportions described in order to obtain the advantageous properties characteristic of the new alloy. For example, copper is an element that is effective in increasing corrosion resistance and preventing coarsening of the crystal grains, as well as in improving soft magnetic characteristics such as core loss and permeability. However, if the amount of Cu used is too small, the benefit of the addition is not obtained. On the other hand, if the amount of Cu used is too large, the magnetic properties are adversely affected. A range of 0.005 to 0.05 for "a", preferably 0.01 to 0.04 has been found to be effective.

At least one rare earth element, "M", is required to improve soft magnetic characteristics such as reduced core loss, improved magnetic characteristics with respect to change of temperature, and to make the crystal grain size more uniform. However, if the amount of "M" used is too small, the benefit of the addition is not obtained. On the other hand, if the amount used is too large, the Curie temperature becomes low, adversely affecting the magnetic characteristics. A range of 0.005 to 0.1 for "b" is therefore selected. Preferably the range is 0.01 to 0.08 , and even more preferably 0.02 to 0.05.

Combined addition of Cu and rare earth element(s) results in the benefit that the magnetic characteristics with respect to temperature variation are improved.

At least one of Si, B, P and C (designated "Y" in aforementioned formula) is effective in obtaining the amorphous condition of the alloy during manufacture, or in directly segregating fine crystals. If too little "Y" is used, the benefit of superquenching is lost, and the aforementioned condition is not obtained. On the other hand, if too much is used, the saturation magnetic flux density is lowered with the result that the aforesaid condition becomes difficult to obtain and superior magnetic properties are therefore not obtained. An amount of "Y" in the range 15 to 28 at % is therefore selected. Preferably the amount is 18 to 26 at %. It is also desirable that the ratio (Si, C) to (B, P) is preferably greater than 1.

The Fe-based soft magnetic alloy of this invention may be obtained by the following method:

An amorphous alloy thin strip is obtained by liquid quenching or from a quenched powder obtained by the atomizing method. The alloy is heat treated for from one minute to 10 hours, preferably 10 minutes to 5 hours at a temperature of from 50° C. below the crystallization temperature to 120° C. above the crystallization temperature, preferably from 30° C. below to 100° C. above the crystallization temperature of the amorphous alloy, to segregate the required fine crystals. An alternative method of directly segregating the fine crystals is by controlling quenching rate in the liquid quenching method.

As indicated previously, it is important that the alloy contain fine crystal grains. However, if the amount of fine crystal grains in the alloy of this invention is too small, i.e., if the amorphous phase is great, there is a tendency toward increased deterioration of the magnetic properties on resin molding, with resulting increased core loss, lower permeability, and increased magnetostriction. The amount of fine crystal grains in the alloy is advantageously at least 30% in terms of area ratio, preferably, at least 40% and may be greater than 50%.

It has also been determined that if the crystal grain size in these fine crystal grains is too small, the maximum improvement in magnetic properties is not obtained. On the other hand, if it is too large, the magnetic properties are adversely affected. It is therefore preferable that the proportion of crystal grains of grain size 50 Å to 300 Å should be at least 80%.

The Fe-based soft magnetic alloy of this invention has excellent soft magnetic characteristics at high frequency. It also has excellent characteristics for use in magnetic components such as the magnetic cores that are used at high frequency, as for example in magnetic heads, thin film heads, high power radio frequency transformers, saturable reactors, common mode choke coils, normal mode choke coils, high voltage pulse noise filters, magnetic switches used in laser power sources, etc., and magnetic materials for various types of sensors, such as power source sensors, direction sensors, and security sensors.

EXAMPLES

The following examples illustrate the invention:

Amorphous alloy thin strip of strip thickness about 18 micron was obtained by the single roll method from alloys of the compositions shown in Table I. The amorphous alloy thin strips thus obtained were wound to form a toroidal magnetic core of external diameter 18 mm, internal diameter 12 mm, height 4.5 mm. Heat treatment was then performed for about 1 hour at a temperature of about 30° C. higher than the crystallization temperature of each alloy (measured at rate of temperature rise of 10°/minute). The toroidal magnetic cores that were thus produced were then used for measurement.

Also, for comparison, magnetic cores were manufactured by carrying out heat treatment for about 1 hour at a temperature about 70° C. lower than the crystallization temperature of the samples, on magnetic cores after the aforementioned winding.

The ratio of fine crystal grains in the thin strips constituting the magnetic cores that were obtained, and the ratio of fine crystal grains of 50 Å to 300 Å in the aforesaid crystal grains are respectively shown as A and B (%) in Table I.

Table I also shows the mean values obtained when the core loss, magnetostriction, permeability at 1 kHz, 2 mOe and saturation magnetic flux density were measured after heat treatment at B=2 G, F=100 kHz, using, respectively, 5 samples of magnetic cores of the invention in which fine crystal grains were present, and magnetic cores of the comparative examples in which fine crystal grains were not present.

TABLE I

| Alloy composition | A (%) | B (%) | Core loss (mW/cc) | Magneto striction ($\times 10^{-6}$) | Permeability $\mu$'1KHz ($\times 10^4$) | Saturation magnetic flux density (KG) | Notes |
|---|---|---|---|---|---|---|---|
| (Fe0.9Cu0.02Nd0.02)76Si14B10 | 60 | 90 | 320 | 1.2 | 12.9 | 14.1 | Composition of the invention |
| " | 0 | 0 | 930 | 18.8 | 0.82 | 14.1 | Composition of the invention |
| (Fe0.96Cu0.01Y0.03)78Si12B10 | 65 | 85 | 345 | 1.0 | 11.8 | 14.3 | Composition of the invention |

TABLE I-continued

| Alloy composition | A (%) | B (%) | Core loss (mW/cc) | Magneto striction ($\times 10^{-6}$) | Permeability $\mu$'1KHz ($\times 10^4$) | Saturation magnetic flux density (KG) | Notes |
|---|---|---|---|---|---|---|---|
| " | 0 | 0 | 900 | 17.1 | 0.75 | 14.3 | Composition of the invention |
| (Fe0.93Cu0.03Sm0.04)80Sil2B8 | 70 | 85 | 360 | 0.8 | 10.6 | 14.4 | Composition of the invention |
| " | 0 | 0 | 950 | 17.3 | 0.85 | 14.4 | Composition of the invention |
| (Fe0.96Cu0.02Pr0.02)79Si11B10 | 70 | 90 | 380 | 0.9 | 11.5 | 13.9 | Composition of the invention |
| " | 0 | 0 | 1000 | 18.1 | 0.92 | 13.9 | Composition of the invention |
| (Fe0.96Cu0.02Ce0.04)77Si13B10 | 75 | 85 | 370 | 1.0 | 14.0 | 11.9 | Composition of the invention |
| " | 0 | 0 | 890 | 17.8 | 0.78 | 11.9 | Composition of the invention |
| (Fe0.96Cu0.04)78Si10B12 | 95 | <10 | 1450 | 2.8 | 0.01 | 12.8 | Outside the composition of this invention |
| " | 0 | 0 | 890 | 14.8 | 0.60 | 12.8 | Outside the composition of this invention |

It is clear from Table I that, with the presence of fine crystals, the alloy of the invention shows excellent soft magnetic characteristics at high frequency, with low core loss, low magnetostriction and high permeability, as compared with iron cores of thin strip of other compositions. Furthermore, when these magnetic cores were subjected to impregnation hardening by epoxy resin, the increase in the core loss of the cores having the fine crystal grains of this invention was in each case less than 5%. i.e., excellent magnetic properties were retained. In contrast, the core loss increase of magnetic cores produced using the alloy and amorphous alloy thin strip of the comparative alloys was about three times. Thus, the difference with this invention is remarkable.

It is apparent from the foregoing examples that an Fe-based soft magnetic alloy having the desired alloy composition and fine crystal grains in accordance with the invention possesses excellent soft magnetic characteristics with high saturation magnetic flux density in the high frequency region.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with reference to the appended claims and equivalents, wherein:

What is claimed is:

1. An Fe-based, soft magnetic alloy having fine crystal grains dispersed in an amorphous phase and conforming to the following formula:

$$(Fe_{1-a-b}\,Cu_aM_b)_{100-c}\,Y_c;$$

where

"M" is at least one rare earth element;

"Y" is at least one element selected from the group consisting of Si, B, P, and C; and wherein "a" and "b" are as follows:

$$0.005 \leqq a \leqq 0.05$$

$$0.005 \leqq b \leqq 0.1$$

and "c", expressed in atomic %, is as follows:

$$15 \leqq c \leqq 28.$$

2. An Fe-based, soft magnetic alloy according to claim 1, wherein the area ratio of said fine crystal grains in the alloy is at least 30%.

3. An Fe-based soft magnetic alloy according to claim 1 wherein at least 80% of said fine grains are in the range of 50 Å to 300 Å.

4. An Fe-based soft magnetic alloy according to claim 1 wherein the ratio of (Si, C) to (B, P,) is greater than 1.

5. An Fe-based soft magnetic alloy according to claim 1 wherein at least 80% of said fine crystal grains are in the range of 50 Å to 300 Å.

6. An Fe-based soft magnetic alloy according to claim 1 wherein "a" is within 0.001 to 0.04.

7. An Fe-based soft magnetic alloy according to claim 1 wherein "b" is in the range of 0.01 to 0.08.

8. An Fe-based soft magnetic alloy according to claim 1 wherein "b" is in the range of 0.02 to 0.05.

9. An Fe-based soft magnetic alloy according to claim 1 wherein the amount of "Y" is in the range of 15 to 28 Atomic %.

10. An Fe-based soft magnetic alloy according to claim 1 wherein the amount of "Y" is in the range of 18 to 26 Atomic %.

11. An Fe-based soft magnetic alloy according to claim 1 wherein the ratio of (Si, C,) to B, P,) is greater than 1.

* * * * *